US010043355B2

(12) United States Patent
Berglund et al.

(10) Patent No.: US 10,043,355 B2
(45) **Date of Patent: *Aug. 7, 2018**

(54) SECURITY DEVICES FOR PRODUCTS

(71) Applicant: InVue Security Products Inc., Charlotte, NC (US)

(72) Inventors: David N. Berglund, Indian Trail, NC (US); Jeffrey A. Grant, Charlotte, NC (US); Andrew W. Moock, Brecksville, OH (US); Trent A. Kirk, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/810,952

(22) Filed: Nov. 13, 2017

(65) Prior Publication Data

US 2018/0068539 A1 Mar. 8, 2018

Related U.S. Application Data

(63) Continuation of application No. 14/779,776, filed as application No. PCT/US2014/033465 on Apr. 9, 2014.

(Continued)

(51) Int. Cl.

| | |
|---|---|
| ***G08B 13/12*** | (2006.01) |
| ***G08B 13/06*** | (2006.01) |
| ***G08B 13/24*** | (2006.01) |

(52) U.S. Cl.

CPC ..... *G08B 13/06* (2013.01); *G08B 13/2434* (2013.01)

(58) Field of Classification Search

CPC ..... G08B 13/06; G08B 13/2434

(Continued)

(56) References Cited

U.S. PATENT DOCUMENTS

| | | |
|---|---|---|
| 4,258,358 A | 3/1981 | Lee et al. |
| 4,772,878 A | 9/1988 | Kane |

(Continued)

FOREIGN PATENT DOCUMENTS

WO 2009020563 A1 2/2009

OTHER PUBLICATIONS

"Self Alarming Tags—WGSPI" (see website at www,wgspi.com/self_alarming_tags), printed on Jun. 3, 2013, 3 pages, WG Security Products.

(Continued)

*Primary Examiner* — Ojiako Nwugo
(74) *Attorney, Agent, or Firm* — InVue Security Products Inc.

(57) ABSTRACT

A security device for protecting objects from theft or unauthorized removal includes a first component configured to be fixed to an object and a second component configured to be removably secured to the first component. The second component includes an alarming mechanism configured to be armed prior to the second component being secured to the first component. The alarming mechanism may include one or more actuating mechanisms that actuate the alarming mechanism. In certain embodiments the second component is configured to slidably engage the first component. In other embodiments, the security device further includes a cable having an end attached to the first component or the second component.

20 Claims, 11 Drawing Sheets

Related U.S. Application Data

(60) Provisional application No. 61/833,542, filed on Jun. 11, 2013, provisional application No. 61/810,033, filed on Apr. 9, 2013.

(58) Field of Classification Search
USPC ..... 340/568.2, 568.1, 571, 572.1, 572.9
See application file for complete search history.

(56) References Cited

U.S. PATENT DOCUMENTS

| | | | |
|---|---|---|---|
| 4,992,776 | A | 2/1991 | Crossfield |
| 5,570,080 | A | 10/1996 | Inoue et al. |
| 5,745,965 | A | 5/1998 | Stoltz et al. |
| 7,190,272 | B2 | 3/2007 | Yang et al. |
| 7,385,521 | B2 | 6/2008 | Macari |
| 7,385,522 | B2 | 6/2008 | Belden, Jr. et al. |
| D578,030 | S | 10/2008 | Yang et al. |
| 7,474,222 | B2 | 1/2009 | Yang et al. |
| D599,242 | S | 9/2009 | Yang |
| RE41,550 | E | 8/2010 | Huehner |
| D624,447 | S | 9/2010 | Yang |
| 7,961,100 | B2 | 6/2011 | Wyatt, Jr. et al. |
| 7,990,273 | B2 | 8/2011 | Handyside et al. |
| D649,898 | S | 12/2011 | Yang |
| 8,284,062 | B2 | 10/2012 | Wyatt, Jr. et al. |
| 8,334,776 | B2 | 12/2012 | Yang |
| 8,373,564 | B2 | 2/2013 | Wyatt, Jr. et al. |
| 8,514,078 | B2 | 8/2013 | Lax et al. |
| 2006/0137409 | A1 | 6/2006 | Fawcett et al. |
| 2006/0170550 | A1 | 8/2006 | Marsilio et al. |
| 2007/0146134 | A1 | 6/2007 | Belden et al. |
| 2007/0152836 | A1 | 7/2007 | Nagelski et al. |
| 2009/0267766 | A1* | 10/2009 | Pasma ..... G08B 13/1409 340/568.2 |
| 2010/0231388 | A1 | 9/2010 | Shute et al. |
| 2010/0315238 | A1 | 12/2010 | Yang |
| 2010/0315239 | A1 | 12/2010 | Yang |
| 2012/0206263 | A1 | 8/2012 | Yang |
| 2012/0229975 | A1 | 9/2012 | Yang |
| 2012/0241522 | A1 | 9/2012 | Yang |
| 2013/0119145 | A1 | 5/2013 | Yang |
| 2015/0287299 | A1 | 10/2015 | Eckert et al. |
| 2016/0049055 | A1 | 2/2016 | Berglund et al. |

OTHER PUBLICATIONS

"WG Media Tag" (see www.youtube.com/watch?v=D_75GLcXQJo), Dec. 20, 2012, 1 page, WG Security Products.

"The Ninja Tag—You Tube" (see www.youtube.com/watch?v=eNBjQ9jlv-A), Apr. 23, 2013, 1 page, WG Security Products.

"Ninja Tag" (see website at www.wgspi.com/p2264-ninja_tag), printed on Jun. 3, 2013, 1 page, WG Security Products.

International Search Report and Written Opinion from corresponding International Patent Application No. PCT/US2014/033465; dated Aug. 22, 2014; 9 pages.

Supplementary European Search Report from corresponding European Patent Application No. 14782369.4; dated Jan. 28, 2016; 8 pages.

* cited by examiner

SECURITY DEVICES FOR PRODUCTS

CROSS REFERENCE TO RELATED APPLICATIONS

This application is a continuation of U.S. patent application Ser. No. 14/779,776, filed on Sep. 24, 2015, which is a 371 National Phase entry of International Application No. PCT/US2014/033465, filed on Apr. 9, 2014, which claims the benefit of priority to U.S. Provisional Application No. 61/833,542 filed on Jun. 11, 2013, and to U.S. Provisional Application No. 61/810,033, filed Apr. 9, 2013, the entire disclosures of which are incorporated herein by reference.

BACKGROUND OF THE INVENTION

Embodiments of the present invention relate generally to security devices and associated methods for protecting objects from theft or unauthorized removal such as, for example, sell-through merchandise in a retail store.

Various devices and methods are known for protecting sell-through merchandise from theft in a retail environment. For example, some retail stores attach a security device, commonly referred to in the merchandise security art as a "bug," to the product or to the packaging of the product. Some retail stores use security devices that are removably attached to a product by a cable. Security devices of this type are commonly referred to in the art as "cable wraps." An alarm may be activated in the event that the security device is removed from the product or the product packaging in an unauthorized manner.

Known devices and methods for protecting products from theft, however, are not entirely effective. In particular, certain of the known security devices are capable of false alarming even when not attached to a product or product packaging. Moreover some products can be damaged by the process of removing the security device. Other known security devices are costly and complex. In addition, cable wraps are difficult to use, are easily damaged, and are inherently less reliable.

In view of the foregoing, it is apparent that a need exists for an improved security device for protecting objects from theft or unauthorized removal. More particularly, a need exists for a security device that is more effective for protecting products in a retail environment, for example, sell-through merchandise. A more effective security device is needed that is easier to attach to a product or to product packaging, does not damage the product or the product packaging, is durable, and/or is inherently more reliable.

BRIEF SUMMARY OF THE INVENTION

In one aspect, the invention is embodied by a security device for protecting a product from theft or unauthorized removal from a predetermined area. The security device includes a first component configured to be fixed to an object, and a second component configured to be removably secured to the first component. The second component includes an alarming mechanism configured to be armed prior to the second component being secured to the first component. The alarming mechanism may include one or more actuation mechanisms for actuating the alarm mechanism. In some embodiments, a first actuation mechanism is a plunger switch and a second actuation mechanism is a rotatable member. The first actuation member may be configured to engage the object generally perpendicular to the object, and the second actuation mechanism may be configured to engage the object generally parallel to the object. If desired, the first actuation mechanism and the second actuation mechanism may be integrated into a single actuation component, such as a rotatable plunger switch.

In some aspects, the first component has at least one first engagement feature and the second component has at least one second engagement feature configured to engage the first engagement feature. In one embodiment, the first engagement feature is a pair of rails extending along lateral edges of the first component and the second engagement feature is a slot configured to engage the rails. In other embodiments, the second component further includes a magnetically actuated disarming switch, such as a reed switch.

In another aspect, the invention is embodied by a security device including a first component configured to be fixed to an object, and a second component configured to be removably secured to the first component. The second component includes an alarming mechanism configured to be armed when the second component is secured to the first component. Furthermore, the second component is configured to slidably engage the first component along an axis defined by the first component.

In another aspect, the invention is embodied by a security device including a first component configured to be fixed to an object, and a second component configured to be slidably secured onto the first component. The security device further includes a cable having a first end attached to the first component or the second component. The second end of the cable may be secured to another object different than the object, or alternatively, may be wrapped about the object. In one example, the cable includes at least one conductor in electrical communication with the alarming mechanism, wherein the alarming mechanism is configured to detect an interruption in a signal transmitted through the at least one conductor.

In another aspect, the invention is embodied by a security system for securing an object. The system includes a first component configured to be fixed to an object, and a second component configured to be removably secured to the first component. The second component includes an alarming mechanism configured to be armed prior to the second component being secured to the first component. The security system further includes a key configured to engage the second component, wherein the key is operable for disarming the alarming mechanism.

In another aspect, the invention is embodied by a method for securing an object. The method includes fixing a first component to an object. The method further includes removably securing the second component to the first component. An alarming mechanism associated with the second component is armed when the second component is secured to the first component.

In another aspect, the invention is embodied by a method for securing an object. The method includes fixing a first component to an object. The method further includes slidably engaging the second component with the first component along an axis defined by the first component. An alarming mechanism associated with the second component is armed when the second component is secured to the first component. In some embodiments, arming the alarming mechanism occurs prior to slidably engaging the second component with the first component. In other embodiments, arming the alarming mechanism occurs after slidably engaging the second component with the first component. In other embodiments, the method further includes fixing an end of a cable attached to the first component or the second component to another object different than the object fixed to the first component. In other embodiments, the method further includes wrapping an end of a cable attached to the first component or the second component at least partially about the object.

BRIEF DESCRIPTION OF THE DRAWING FIGURES

DETAILED DESCRIPTION OF EMBODIMENTS OF THE INVENTION

Figure 1:
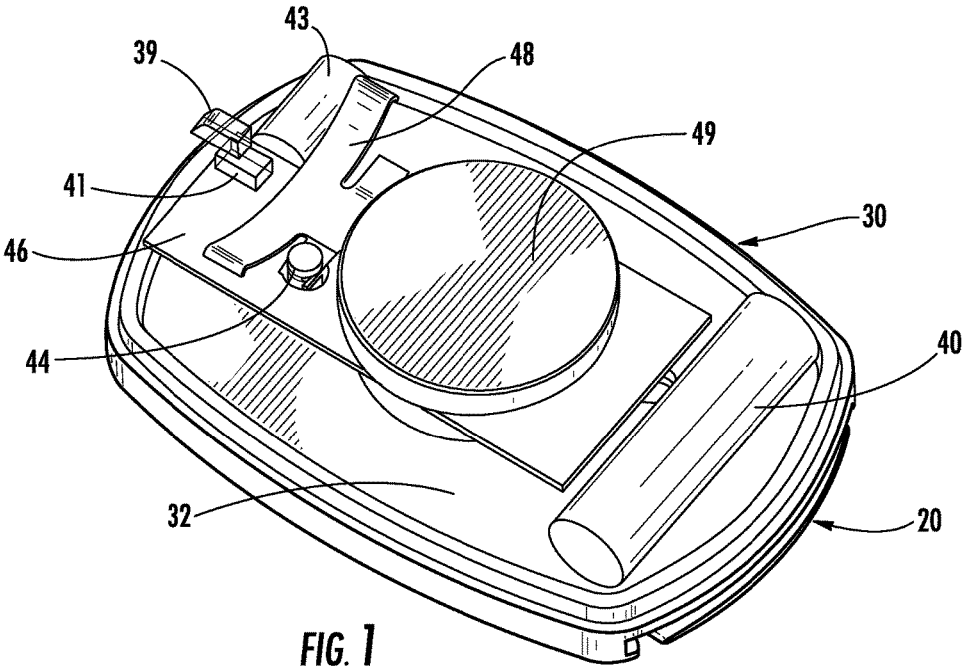
FIG. 1 is a perspective view showing a housing of a security device according to one embodiment of the present invention as seen from above with a top portion of the housing removed for purposes of clarity.

Embodiments of the present invention will now be described more fully hereinafter with reference to the accompanying drawings, in which exemplary embodiments of the invention are shown. This invention may, however, be embodied in many different forms and should not be construed as limited to the embodiments set forth herein. Rather, the exemplary embodiments are provided so that this disclosure will be thorough and complete, and will fully convey the scope of the invention to those skilled in the art.

Reference will now be made to the accompanying drawing figures wherein identical reference numerals denote the same or similar elements throughout the various views. The attached figures show various exemplary embodiments of a security device for protecting an object against theft and/or unauthorized removal. For example, the security device may be used to protect against removal of an object from a predetermined area defined by a perimeter. As used herein, the term "object" is intended to include without limitation any item desired to be protected from theft, such as any type of product, including items of retail merchandise, and packaging for items of retail merchandise. In the exemplary embodiments shown and described herein, the security device is configured to protect sell-through merchandise in a retail store environment.

FIGS. 1-6 best show an embodiment of a security device, indicated generally herein by the reference character 10, according to the present invention. The security device 10 comprises a first component 20 or member configured to be fixed to an object, and a second component 30 or member configured to be received by the first component and removably secured thereon. As previously mentioned, the object may be a product or packaging for a product. By way of example and not limitation, as shown and described herein the object is packaging for a product, and more specifically, packaging for an item of merchandise stocked in a retail store, commonly referred to as sell-through merchandise. In the exemplary embodiment, the first component 20 of the security device 10 is also referred to herein as the "carrier," while the second component 30 is also referred to herein as the "housing." The housing 30 is sometimes referred to in the merchandise security art as a "bug". The carrier 20 is configured to be affixed, or otherwise securely attached, to the product packaging P, for example by means of a double-sided, pressure-sensitive adhesive or equivalent attachment means, such that the product and the packaging cannot be readily separated from the security device 10 by a potential thief. The housing 30 is configured to be removably secured on the carrier 20, as will be described in greater detail hereafter.

In certain embodiments, the housing 30 is secured on the carrier 20 to arm an alarm, and a key 50 (see e.g., FIG. 12) is required to remove the housing from the carrier without activating the alarm and generating an audio and/or visual alarm signal. In the exemplary embodiments shown and described herein, the housing 30 includes an alarming mechanism for arming an alarm of the security device 10. As will be explained in greater detail hereinafter, the alarming mechanism includes one or more actuation mechanisms for arming the alarm. Typically, the housing 30 is configured to be removed from the carrier 20 at a point-of-sale location, for example a checkout register or a cashier station. Consequently, the carrier 20 may remain with the packaging P, and the housing 30 may be reused thereafter with another carrier 20 attached to the packaging of another item of sell-through merchandise. Accordingly, the carrier 20 may be a disposable component of the security device 10, while the housing 30 may be a reusable component.

As shown in the exemplary embodiments provided herein, the housing 30 includes a housing bottom portion 32 and a housing top portion 34. The bottom portion 32 and the top portion 34 may be independent elements secured together, or otherwise engaged with one another, for example by ultrasonic welding following assembly of the interior components of the housing 30. Alternatively, in other embodiments the bottom portion 32 and the top portion 34 may be integrally formed as a single component. Regardless, the housing 30 may include at least one key hole 35 (e.g., FIG. 3) defined in the top portion 34 that is configured to receive the key 50 for removing the housing from the carrier 20. The key 50 may be a magnetic key having one or more magnet features configured to engage a plurality of corresponding key holes 35 defined in the top portion 34 of the housing 30. By way of example and not limitation, the key 50 may be a type of magnetic key well known in the merchandise security art as an "S3" style key. Movement of the key 50 while engaged with the housing 30 allows the housing to moved (e.g., slid) out of engagement with the carrier 20. Moreover, the top portion 34 of the housing 30 may further define a light pipe 39 or other visual indicator for indicating whether the alarm of the security device 10 is armed. In addition, an audible indicator may be emitted to likewise indicate whether the alarm of the security device 10 is armed and/or disarmed, as desired.

Figure 2:
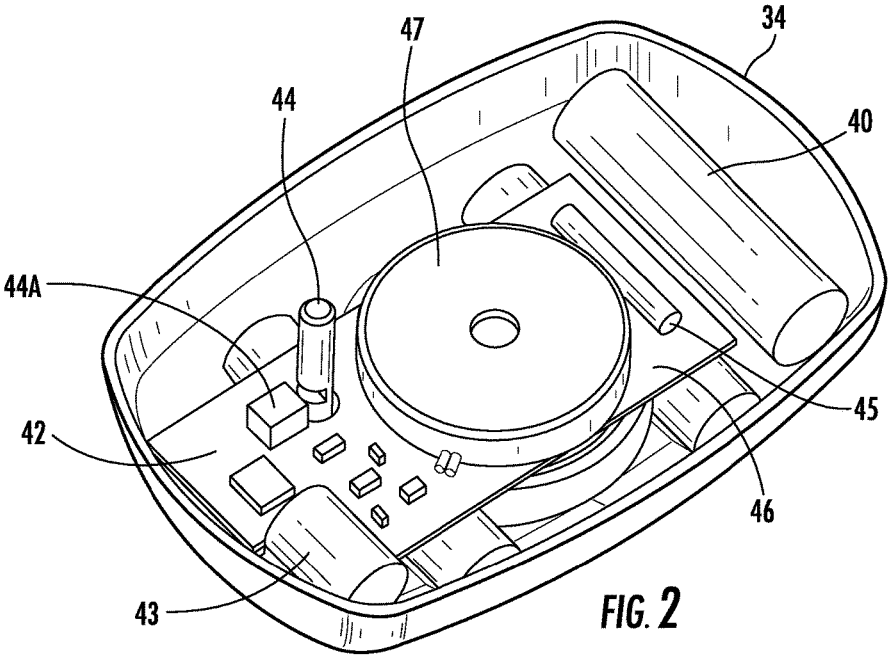
FIG. 2 is a perspective view showing the housing of FIG. 1 as seen from below with a bottom portion of the housing removed for purposes of clarity.

The housing 30 may contain various different components, including the aforementioned alarming mechanism for providing an alarm signal in the event that the housing is removed from the carrier 20, or the carrier is removed from the product packaging P, in an authorized manner. As best shown in FIG. 1 and FIG. 2, the housing 30 may also contain, for example, an electronic article surveillance (EAS) tag 40, a light-emitting diode (LED) 41, a chip set 42, a transformer 43, a plunger 44, a plunger switch 44A, a reed switch 45, a printed circuit board 46, a piezoelectric audio speaker 47, a spring and magnet plate 48, and a battery 49. Importantly, the housing 30 contains a variety of electronic components that are powered by the battery 49 and collectively define the alarming mechanism. As previously mentioned, the housing 30 is configured to be removable from the carrier 20, such that the housing and its associated alarming mechanism may be reusable with a subsequent carrier affixed to another item of sell-through merchandise.

The spring and magnet plate 48 may be formed of a magnetically attractable material, and may be mechanically coupled to an actuation mechanism. In the exemplary embodiments provided herein, the actuation mechanism is plunger 44. Providing a magnetic field in the vicinity of the spring and magnet plate 48 attracts the plate to the magnetic field, thereby retracting the plunger 44 from its biased, extended position. In one embodiment, the one or more magnets of the key 50 are configured to be received within the corresponding key holes 35 defined in the top portion 34 of the housing 30 to thereby retract the plunger 44 from its biased extended position into the housing. The reed switch 45 may be configured to detect that the one or more magnets 54 of the magnetic key 50 are engaged with the key holes 35 of the housing 30 and change state in response to the presence of the key. By way of example, the reed switch 45 may be operable to disarm the alarming mechanism in response to detection of the presence of the magnetic key 50, thereby allowing the housing 30 to be removed from the carrier 20 in an authorized manner without activating an audible and/or visual alarm signal.

Figure 3:
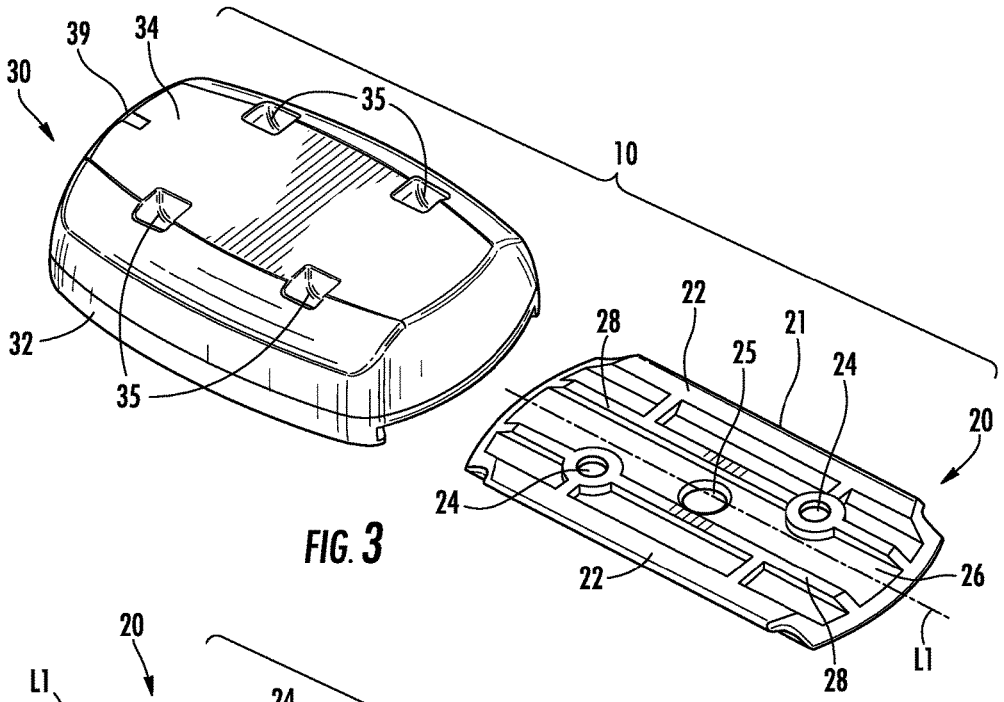
FIG. 3 is a perspective view showing the housing of FIG. 1 and a carrier of the security device according to one embodiment, as seen from above.
Figure 4:
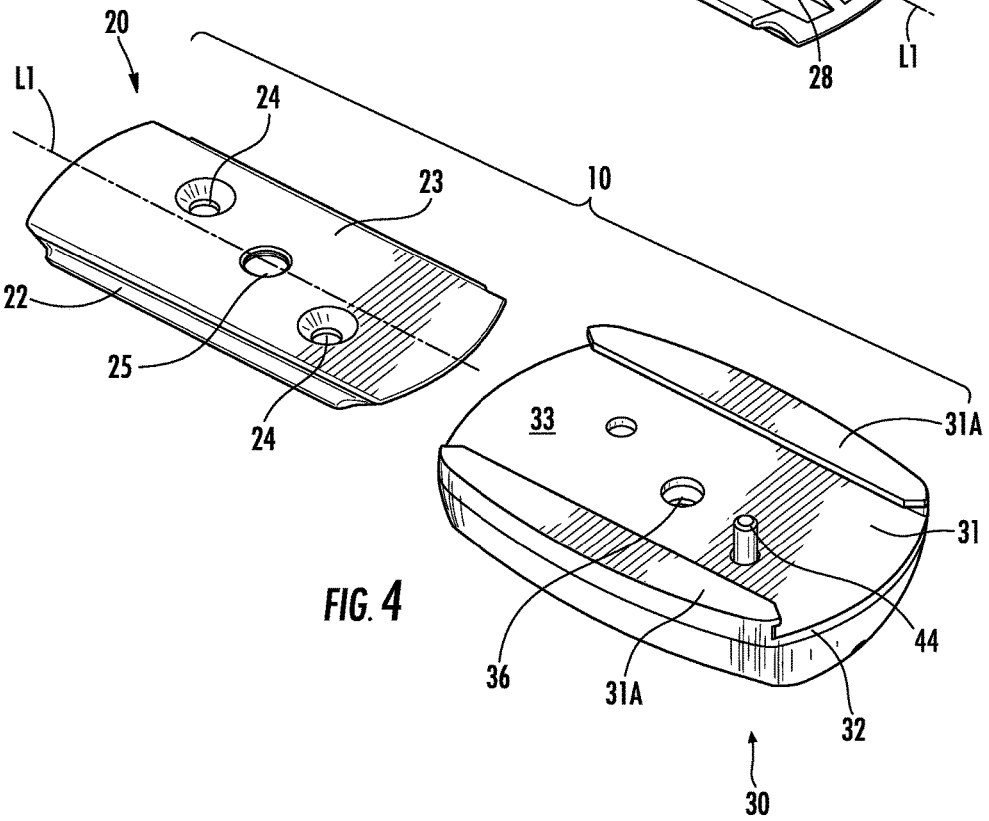
FIG. 4 is a perspective view of the housing of FIG. 1 and the carrier of FIG. 3, as seen from below.
Figure 5:
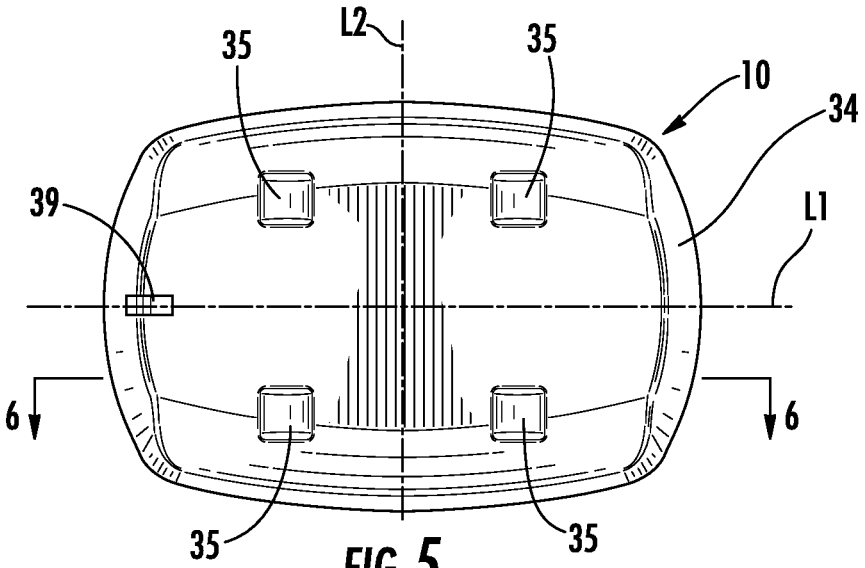
FIG. 5 is a plan view showing the security device, as seen from above.
Figure 6:
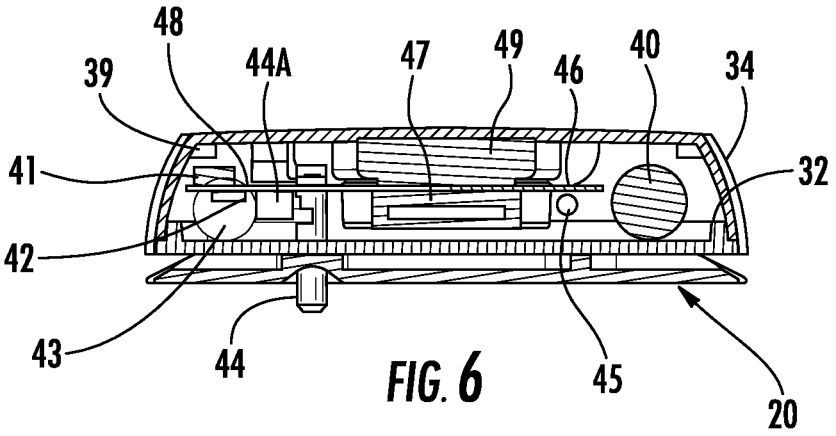
FIG. 6 is a sectional view of the security device taken along the line 6-6 indicated in FIG. 5.

As best shown in FIG. 3, a top side 21 of the carrier 20 may comprise at least one engagement feature, such as a pair of opposing rails 22 that extend generally parallel to one another and to a central longitudinal axis L1 defined by the carrier. Rails 22 may be disposed at any desired lateral distance outward from the longitudinal axis L1. For example, rails 22 may extend along the opposing lateral edges of the top side 21 of the carrier 20. Regardless, the rails 22 are configured to slidably engage a corresponding engagement feature defined on the underside 31 of the bottom portion 32 of the housing 30. In this regard, the bottom portion 32 of the housing 30 may define a slot 33 for receiving the carrier 20 (see e.g., FIG. 4). More specifically, the rails 22 on the top side 21 of the carrier 20 engage with the slot 33 such that the bottom side 23 of the carrier is essentially flush with the lateral sides 31A on the underside 31 of the bottom portion 32 of the housing 30. As will be readily understood and appreciated by those skilled in the art, the slot 33 formed in the housing 30 may be configured to engage the rails 22 provided on the top side 21 of the carrier 20 in either direction along the central longitudinal axis L1. In this manner, either end of the housing 30 may be slid onto the carrier 20 from either direction. In the exemplary embodiments shown and described herein, both the housing 30 and the carrier 20 are symmetrical about the longitudinal axis L1 and a lateral axis L2 that is generally perpendicular to the longitudinal axis.

As shown herein, the carrier 20 may lie entirely within a substantially planar plane. Namely, the carrier 20 may have a relatively low profile that is fairly unnoticeable to the purchaser when the housing 30 of the security device 10 has been removed from the carrier. In addition, the carrier 20 specifically does not include any projections, protrusions, elements, components or the like that require compliance by a sales associate to arm the security device 10, add unnecessary cost to the carrier, or that could potentially injure the purchaser after the housing 30 has been removed. The carrier 20 may have at least one plunger hole 24 formed therethrough. In the exemplary embodiment shown in FIG. 3 and FIG. 4, the carrier 20 includes a plurality of plunger holes 24. As previously mentioned, the housing 30 includes an actuation mechanism, such as a biased plunger 44, that extends outwardly from the housing and into one of the plurality of plunger holes 24 provided on the carrier 20 when the carrier 20 is affixed to the packaging P and the housing is secured onto the carrier. Thus, the plunger 44 is configured to extend from the housing 30 and through one of the plurality of plunger holes 24 to engage the product packaging P beneath the carrier. As a result, the biased plunger 44 does not engage the carrier 20 with the security device 10 in an armed position, for a purpose to be described hereinafter.

If desired, the carrier 20 may include at least one sound attenuation hole 25 formed therethrough and a sound attenuation channel 26 in audio communication with the sound hole. Likewise, the bottom portion 32 of the housing 30 may include a corresponding sound attenuation hole 36 formed therethrough. As previously mentioned, housing 30 may include a piezoelectric audio speaker 47. Speaker 47 is positioned in the bottom portion 32 of the housing 30 immediately above sound hole 36, and if likewise provided, sound hole 25 of carrier 20. The speaker 47 is operable for emitting an audio alarm signal in response to actuation of the alarming mechanism of the security device 10. The sound hole 25 and associated sound channel 26 of carrier 20 are operable to convey and amplify the audio alarm signal emitted by the speaker 47 in the event that the alarming mechanism is actuated by an actuating mechanism, as will be explained in greater detail below.

The carrier 20 may further comprise at least one longitudinally extending carrier ramp 28 defined along at least a partial length of the top side 21 of the carrier. As best shown in FIG. 3, the carrier 20 may comprise a pair of longitudinally extending ramps 28 defined along the entire length of the top side 21 of the carrier. Each ramp 28, or portion thereof, extends between an end of the carrier 20 and a respective plunger hole 24. Thus, one of the ramps 28 engages the biased plunger 44 extending outwardly from the bottom portion 32 of the housing 30 as the housing is installed onto the carrier. For example, as the housing 30 is slid over the carrier 20, the end of the plunger 44 engages the ramp 28 so as to move the plunger upwardly into the housing against the biasing force exerted on the plunger. When the housing 30 is fully positioned over the carrier 20, the end of the plunger 44 is received within the respective plunger hole 24 of the carrier and extends under the biasing force to an armed position in engagement with the product packaging P.

Figure 7:
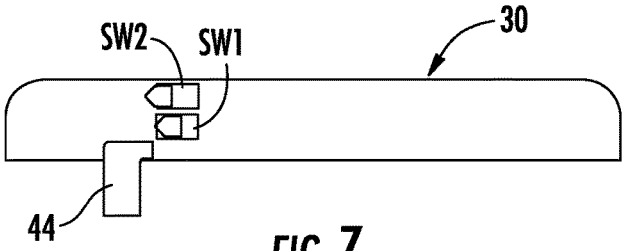
FIG. 7 is a schematic diagram illustrating the housing of a security device according to one embodiment of the invention in a standby position.
Figure 8:
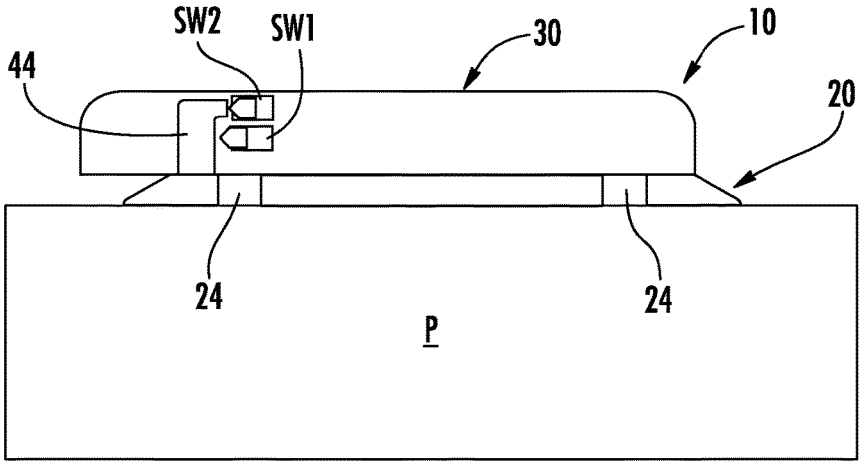
FIG. 8 is a schematic diagram illustrating the carrier of the security device of FIG. 7 affixed to product packaging, and the housing of the security device engaged with the carrier in an installation position.
Figure 9:
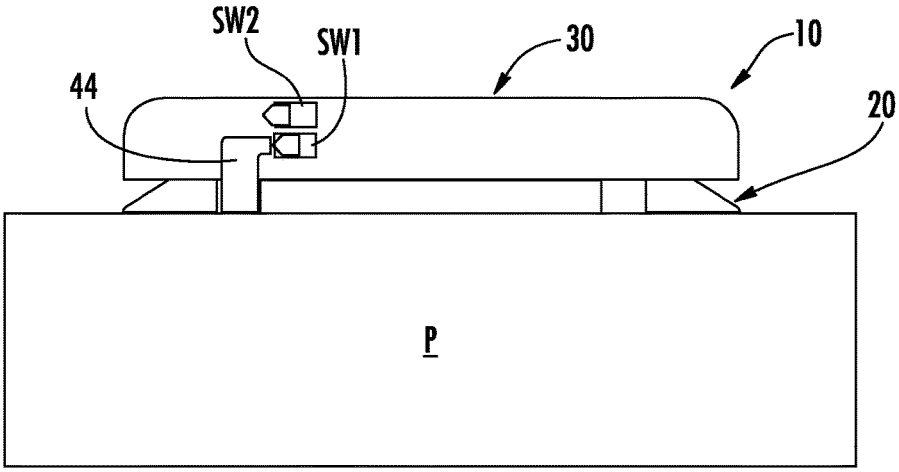
FIG. 9 is a schematic diagram illustrating the carrier of the security device of FIG. 7 affixed to the product packaging, and the housing of the security device secured onto the carrier in an armed position.

FIGS. 7-9 illustrate an exemplary embodiment of a means for selectively displacing the plunger 44 of the security device 10 between a standby position (FIG. 7), an installation position (FIG. 8), and armed position (FIG. 9). In this regard, the plunger 44 is configured to be in a standby position prior to engagement of the housing 30 with the carrier 20. In the installation position, the plunger 44 engages one of the ramps 28 defined on the carrier 20, the alarming mechanism is not armed, and the housing 30 is not yet secured onto the carrier. In the armed position, the plunger 44 extends through a plunger hole 24 formed in the carrier 20 and engages the product packaging P. It should be noted that in each of the standby position, the installation position, and the armed position the biased plunger 44 may be disposed at a different height with respect to the housing 30. For example, the plunger 44 may extend further outwardly from the housing 30 in the standby position (FIG. 7) than in the armed position (FIG. 9). In addition, the plunger 44 may extend to a height located between the standby position and the armed position in the installation position. In the intermediate installation position (FIG. 8), the plunger 44 may be in its fully retracted condition into the housing 30. As noted above, the installation position corresponds to a configuration wherein the plunger 44 engages the carrier 20, but the security device 10 is not yet armed.

As previously mentioned, the plunger 44 may be operably coupled with at least one actuation mechanism. In the embodiment illustrated in FIGS. 7-9, the plunger 44 may be operably coupled with a pair of switches SW1 and SW2 that are movable in a particular sequence to arm the alarming mechanism. In one embodiment, vertical movement of the plunger 44 actuates each of the pair of switches SW1, SW2. In this regard, the switches SW1 and SW2 may be configured to be actuated independently of one another as the plunger 44 is displaced vertically upward from the standby position (FIG. 7) to the installation position (FIG. 8), and likewise as the plunger is displaced vertically downward from the installation position to the armed position (FIG. 9). Similarly, the switches SW1 and SW2 may be configured to be actuated independently of one another as the plunger 44 is displaced vertically upward from the armed position back to the installation position, and as the plunger is displaced vertically downward from the installation position back to the standby position.

In the exemplary embodiment illustrated in FIGS. 7-9, the plunger 44 may actuate each of the switches SW1 and SW2 by respective physical engagement with each switch. For example, in the standby position, both switches SW1 and SW2 are disengaged from the plunger 44, and thus, are in an "up" or "open" state. During installation, and more particularly as the housing 30 is slid onto the carrier 20, the plunger 44 is retracted vertically upwards into the housing, thereby engaging switch SW1 and subsequently engaging switch SW2. Accordingly, switch SW1 may be momentarily moved from the "up" or "open" state to a "down" or "closed" state. As shown, switch SW1 may return to the "up" or "open" state once the plunger 44 moves vertically beyond the switch SW1 and into engagement with switch SW2 as the plunger reaches the top surface of the corresponding ramp 28 in the installation position. During the time that the plunger 44 is moving along the top surface of the ramp 28 in the installation position, switch SW2 is consequently in the "down" or "closed" state, while switch SW1 in the "up" or "open" state. When plunger 44 reaches a corresponding plunger hole 24 in the armed position, the plunger moves vertically downward out of engagement with switch SW2 and back into engagement with switch SW1. As a result, switch SW1 is moved into the "down" or "closed" state, while switch SW2 is de-actuated from the "down" or "closed" state to the "up" or "open" state. Specifically, in the armed position, the plunger 44 engages both switch SW1 and the product packaging P, which results in the alarming mechanism arming the alarm.

It should be readily understood and appreciated by those skilled in the art that the alarming mechanism may be actuated by a change in the state of at least a first switch SW1, and in some instances by a change in the state of a second switch SW2 as well. Thus, a change in the state of the alarm occurs when the housing 30, and more specifically the plunger 44, moves from the standby position to the armed position with the carrier 20 affixed to the product packaging P, and with the housing secured on the carrier such that the biased plunger 44 engages the packaging P through the plunger hole 24 of the carrier. In this manner, a particular sequence of the state of first switch SW1 and second switch SW2 is required to actuate the alarming mechanism to arm the alarm. As a result, a security device 10 according to embodiments of the invention may result in fewer, if any, false alarms. In particular, with the housing 30 removed from the carrier 20, the alarming mechanism will not arm the alarm unless the aforementioned sequence of state changes occurs. Consequently, displacement of the plunger 44 from the standby position (e.g., fully extended) to the installation position (e.g., fully retracted) and back to the standby position will not result in actuating the alarming mechanism.

Moreover, where a magnetic key 50 is utilized to remove the housing 30 from the carrier 20 in the manner previously described, the sequence of state changes may be reversed to de-actuate the alarming mechanism, and thereby disarm the alarm. In particular, the magnets 54 of the magnetic key 50 engage the one or more key holes 35 formed in the top portion 34 of the housing 30 with the security device 10 in the armed position such that the magnetic force of the magnets 54 fully retracts the plunger 44 into the housing 30. As a result, switch SW1 changes to the "up" or "open" state, while switch SW2 changes to the "down" or "closed" state. The key 50 is then used to move the housing 30 relative to the carrier 20 into the installation position. The key 50 is then used to completely separate the housing 30 from the carrier 20 and the magnets 54 of the key 50 are removed from engagement with the housing 30. As a result, the security device 10 is in the standby position with the plunger 44 fully extended outwardly from the housing and both the switches SW1 and SW2 returned to the "up" or "open" state such that the alarm is disarmed.

Figure 10:
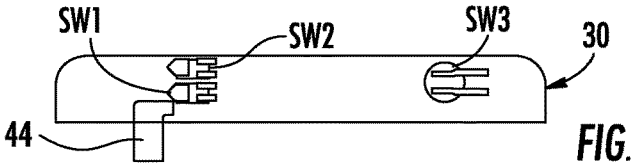
FIG. 10 is a schematic diagram illustrating a housing of a security device according to another embodiment of the invention in a standby position.
Figure 11:
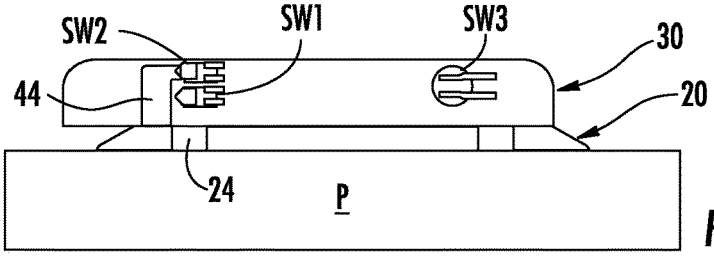
FIG. 11 is a schematic diagram illustrating a carrier of the security device of FIG. 10 affixed to product packaging, and the housing of the security device engaged with the carrier in an installation position.
Figure 12:
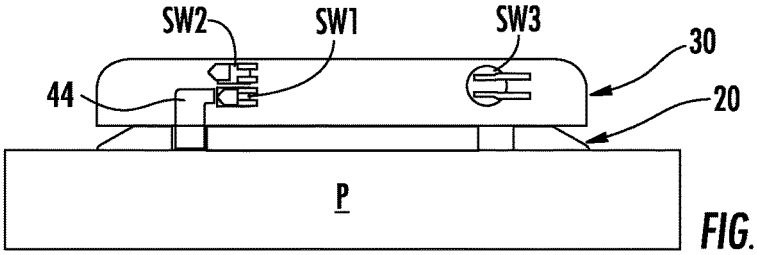
FIG. 12 is a schematic diagram illustrating the carrier of the security device of FIG. 10 affixed to the product packaging, and the housing of the security device secured onto the carrier in an armed position.
Figure 13:
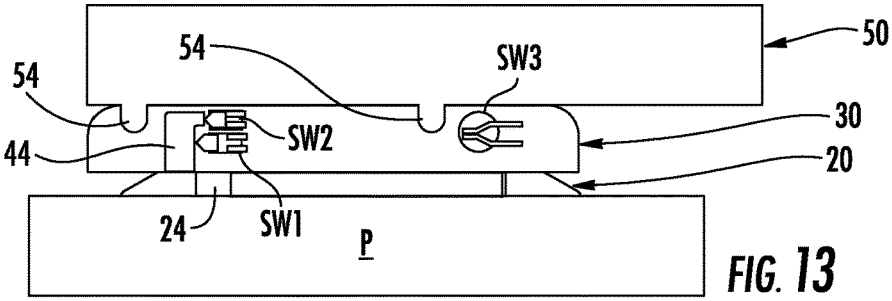
FIG. 13 is a schematic diagram illustrating an embodiment of a magnetic key having one or more magnets operably coupled to housing of the security device of FIG. 10 to remove the housing from the carrier.
Figure 14:
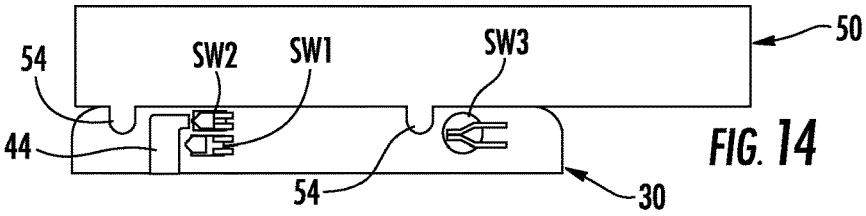
FIG. 14 is a schematic diagram illustrating the housing of the security device of FIG. 10 removed from the carrier, but still in engagement with the magnetic key.
Figure 15:
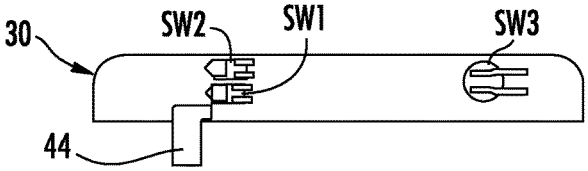
FIG. 15 is a schematic diagram illustrating the housing of the security device of FIG. 10 once again in the standby position.

FIGS. 10-15 illustrate the aforementioned sequence of state changes for a security device that comprises a first switch SW1 and a second switch SW2 as previously described, and in certain embodiments, an additional third switch SW3. The third switch SW3 may be a magnetically actuated disarming switch that is actuated by the one or more magnets 54 of the magnetic key 50. In particular, FIG. 10 illustrates a housing 30 in a standby position with the plunger 44 fully extended and the switches SW1 and SW2 in the open state. FIG. 11 illustrates the housing 30 engaging a corresponding carrier 20 in an installation position with the switch SW1 in the open state and the switch SW2 in the closed state. FIG. 12 illustrates the housing 30 secured on the carrier 20 in an armed position with the switch SW1 in a closed state and the switch SW2 in an open state. FIG. 13 illustrates the key 50 positioned on the housing 30 with the magnets 54 of the key received within the key holes 35 provided in the housing such that the plunger 44 is fully retracted into the housing and the security device 10 moved to the installation position. As a result, the switch SW1 is in the open state, and the switches SW2, SW3 are in the closed state. At this point, the alarming mechanism may disarm the alarm. As a result, an audio and/or a visual alarm signal will not be emitted when the housing 30 is separated from the carrier 20, as illustrated in FIG. 14, and the magnets 54 of the magnetic key 50 are removed from the key holes 35 of the housing, as illustrated in FIG. 15, so that the housing is again in the standby position with the plunger 44 fully extended outwardly from the housing.

Figure 16:
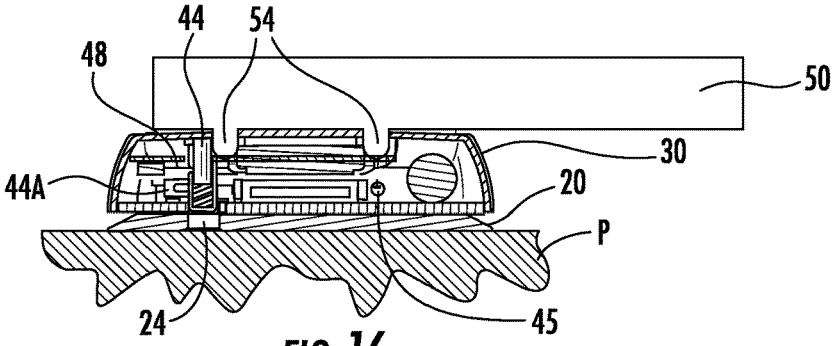
FIG. 16 is a sectional view showing a carrier of a security device affixed to product packaging, a housing of the security device secured onto the carrier, and a key engaged with the housing so that the plunger is fully retracted, according to one embodiment of the present invention.
Figure 17:
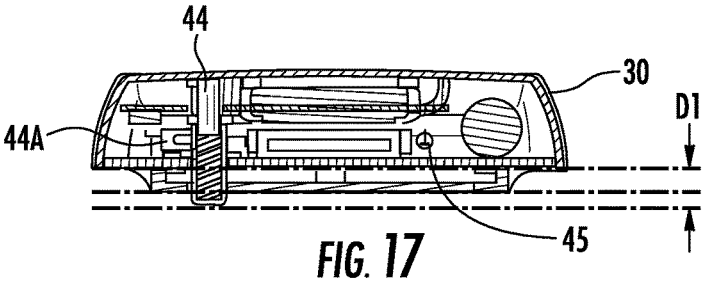
FIG. 17 is a sectional view showing the housing removed from the carrier and the product packaging so that the plunger is fully extended in a standby position.

FIGS. 16-20 show the different positions of the plunger 44 relative to an object, such as product packaging P, a housing 30, and a carrier 20 constructed in accordance with an embodiment of the invention. In particular, FIG. 16 shows the magnets 54 of a magnetic key 50 engaged with the housing 30 such the spring and magnet plate 48 is attracted to the magnets and fully retracts the plunger 44 relative to the packaging P, the carrier 20, and the housing 30. In this configuration, both the plunger switch 44A and the reed switch 45 are closed, and the alarm is disarmed so that an audio and/or a visual alarm signal will not be emitted if the housing 30 is removed from the carrier 20 and the packaging P to a standby position. FIG. 17 shows a standby position in which the biased plunger 44 is fully extended relative to the housing 30 by a distance D1 from the retracted position. In this configuration, both the plunger switch 44A and the reed switch 45 are open and the alarm is not armed.

Figure 18:
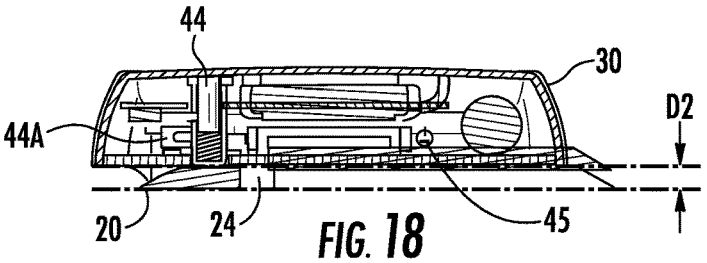
FIG. 18 is a sectional view showing the housing being engaged with the carrier so that the plunger is partially retracted in an installation position.
Figure 19:
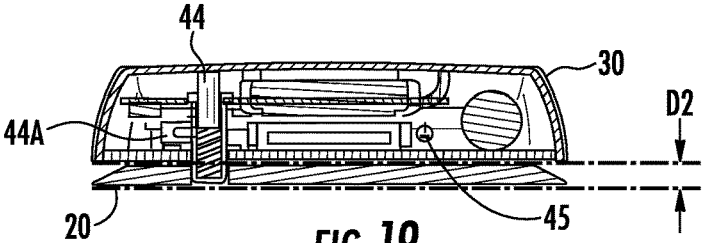
FIG. 19 is a sectional view showing the housing secured onto the carrier so that the plunger is partially extended in an armed position.
Figure 20:
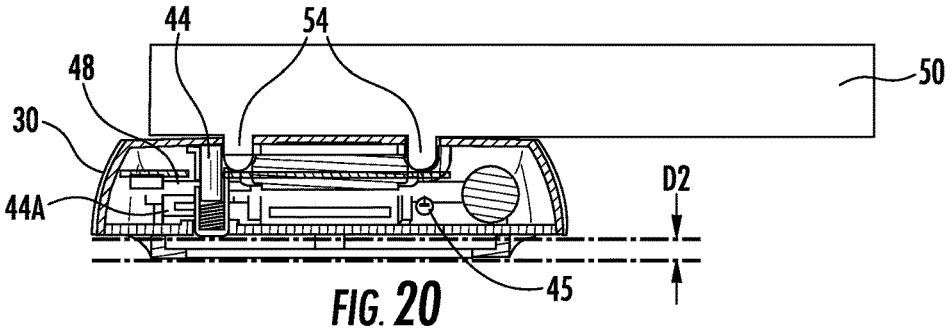
FIG. 20 is a sectional view showing the housing removed from the carrier and the product packaging with the key engaging the housing so that the plunger is fully retracted.

FIG. 18 shows an installation position in which the biased plunger 44 is partially retracted relative to the carrier 20 by a distance D2. In this configuration, the plunger switch 44 is closed and the reed switch 45 is open, and the alarm may not be armed if desired so that an alarm signal will not be emitted if the housing 30 is removed from the carrier 20. FIG. 19 shows an armed position in which the plunger 44 is partially extended relative to the housing 30 and the installation position by the distance D2 and engaging the packaging P. In this configuration, the plunger switch 44 is still closed and the reed switch 45 is open, and the alarm is armed so that the alarm signal will be emitted in the event that the housing 30 is removed from the carrier 20 and the packaging P in an unauthorized manner, or alternatively, the packaging is separated from the carrier and the housing. FIG. 20 shows the plunger 44 fully retracted relative to the packaging P by the distance D2 and the housing 30 removed from the carrier 20 and the packaging with the key 50 engaged with the housing. In this configuration, the plunger switch 44 and the reed switch 45 are closed, as previously described with reference to FIG. 16.

It will be readily understood and appreciated by those skilled in the art that different techniques and switch state change sequences may be employed to actuate or otherwise arm the alarming mechanism. For example, when the housing 30 is placed on an object prior to being received on a carrier 20, the plunger 44 may engage (e.g., be depressed against) the object and retracted to actuate a first switch (e.g., SW1) in an installation position. As the housing 30 is subsequently slid into engagement with the carrier 20, the housing may be displaced to a different height relative to the object. Consequently, the plunger 44 may be partially extended relative to the housing to actuate a second switch (e.g., SW2) in an armed position. With the structural configuration of the housing 30 and the carrier 20 modified in this manner, the carrier 20 need not comprise a ramp or other engagement feature for engaging the plunger 44 to achieve a similar result.

In yet another embodiment, a single switch (e.g., SW1) may be provided whereby the alarming mechanism is armed when the plunger 44 engages an object and is fully retracted to an armed position prior to the housing 30 being engaged with the carrier 20. Thus, the alarming mechanism may be armed, and the housing 30 then secured onto the carrier 20. Similarly, the alarming mechanism may be armed prior to the housing 30 engaging the carrier 20 and the plunger 44 configured to not engage the carrier at all. For example, the carrier 20 may define an opening defining a slot extending from an end that receives the plunger 44 therein as the housing 30 is secured onto the carrier 20. In this case, a second mechanical plunger or similar locking mechanism, such as a locking pin, that does not including any switching functionality may be employed to secure the housing 30 onto the carrier 20.

In yet another embodiment, the plunger 44 may be retracted and actuate a first switch (e.g., SW1) upon engagement with the object and prior to being secured onto the carrier 20 in an installation position. After the housing 30 is slid onto the carrier 20 and secured thereto, the alarming mechanism may include a second actuation mechanism to arm the alarming mechanism in an armed position. For instance, the second actuation mechanism may include a push button or other actuator that is actuated by a retail sales associate to arm the alarming mechanism as desired. The second actuation mechanism may arm the alarming mechanism using any desired technique, such as by closing an electrical circuit or by extending a component to engage the object.

Figure 21:
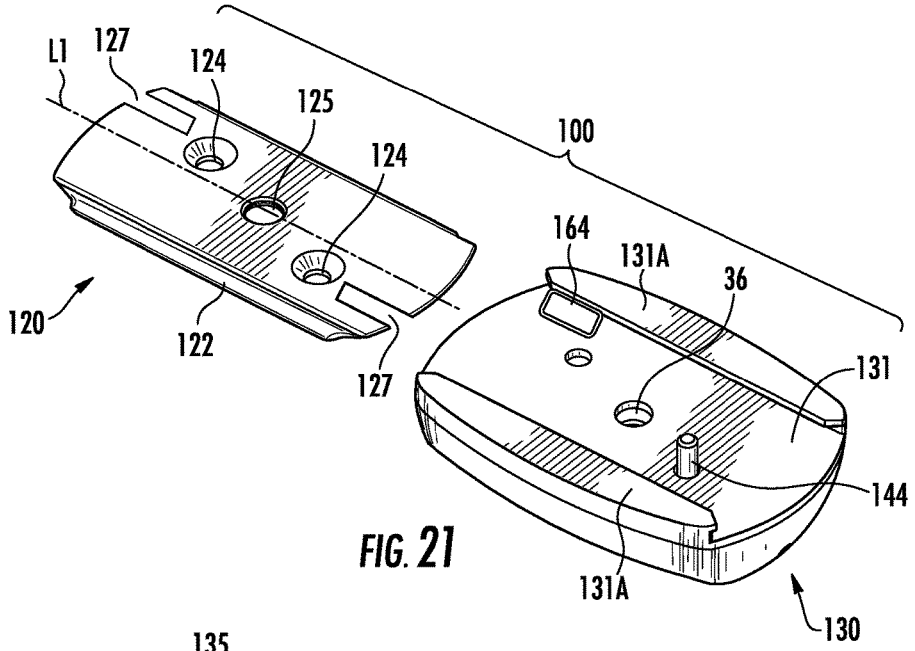
FIG. 21 is a perspective view showing a carrier and a housing of another embodiment of a security device according to the invention, as seen from below.
Figure 22:
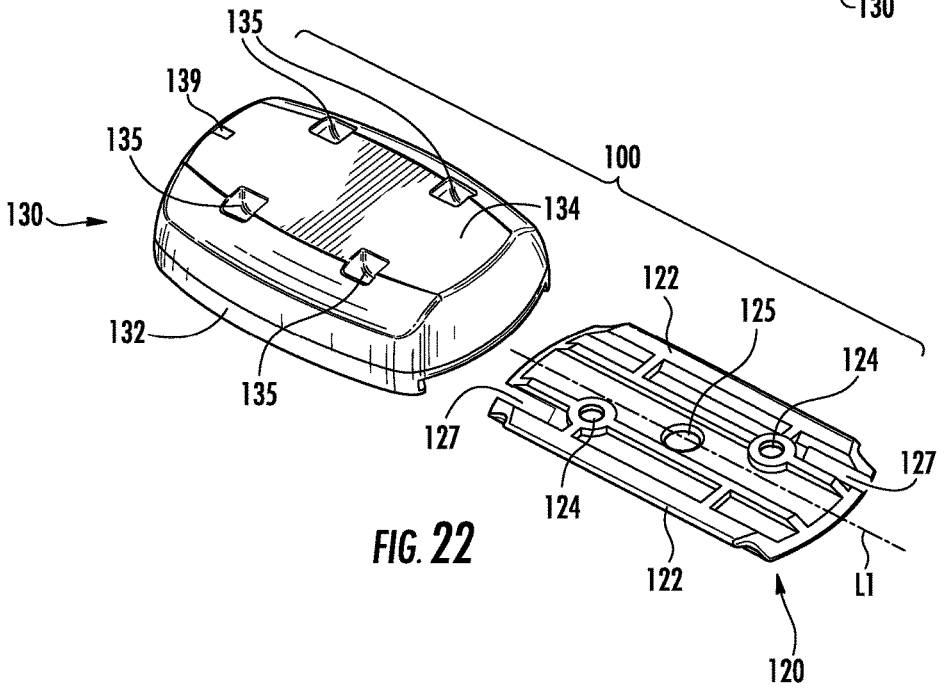
FIG. 22 is a perspective view showing the carrier and the housing of the security device of FIG. 21, as seen from above.
Figure 23:
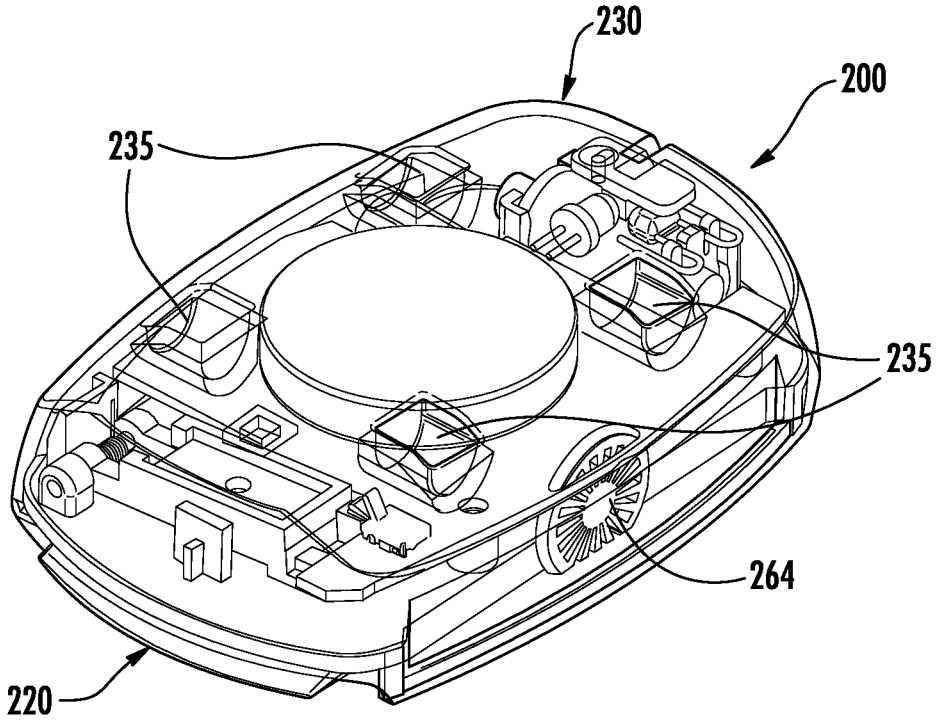
FIG. 23 is a perspective view of another embodiment of a security device according to the invention, as seen from above.
Figure 24:
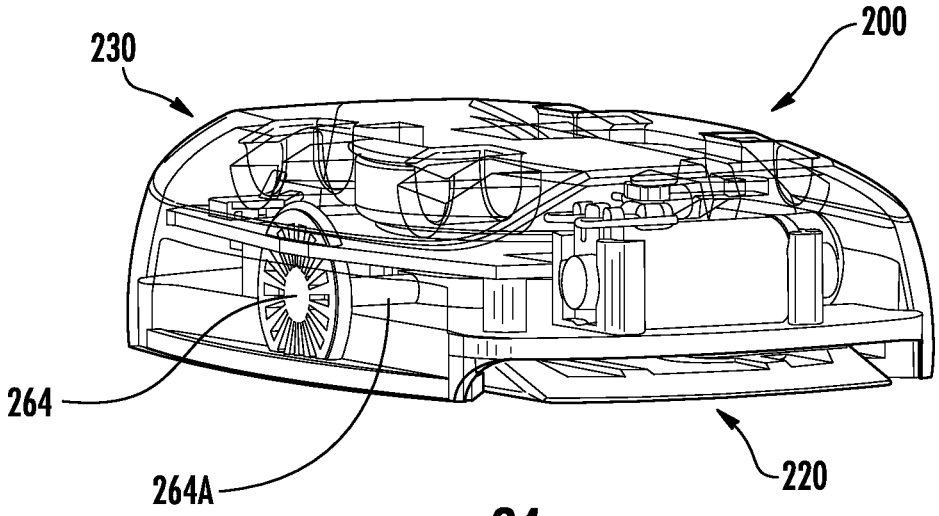
FIG. 24 is another perspective view of the security device of FIG. 23, as seen from a side.
Figure 25:
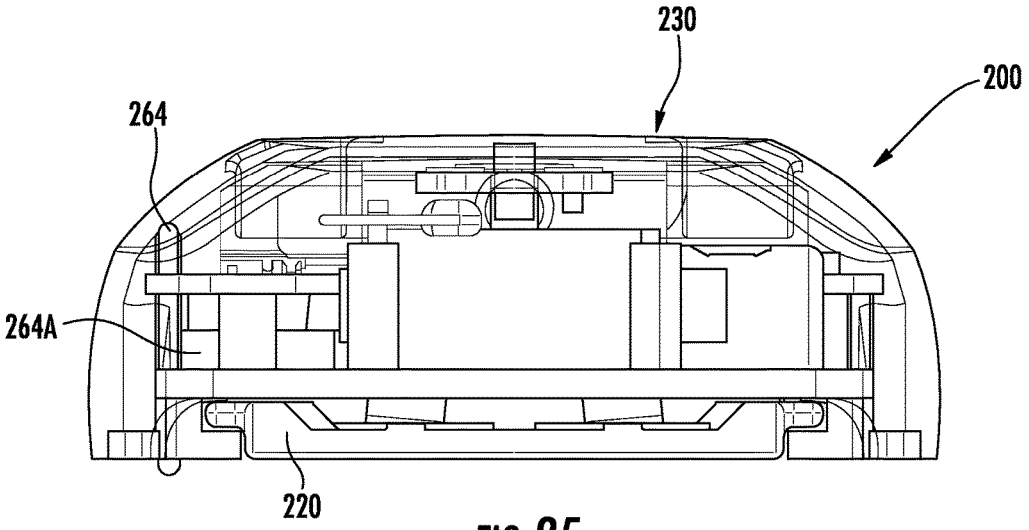
FIG. 25 is an elevation view showing the interior components of the security device of FIG. 23.
Figure 26:
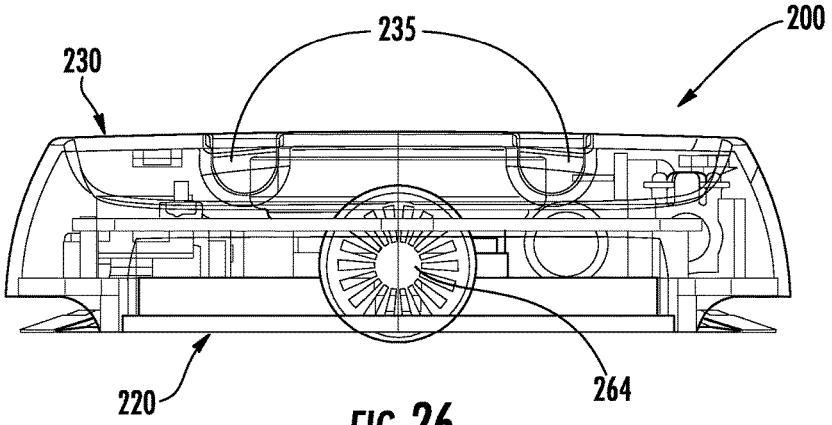
FIG. 26 is a side view showing the interior components of the security device of FIG. 23.
Figure 27:
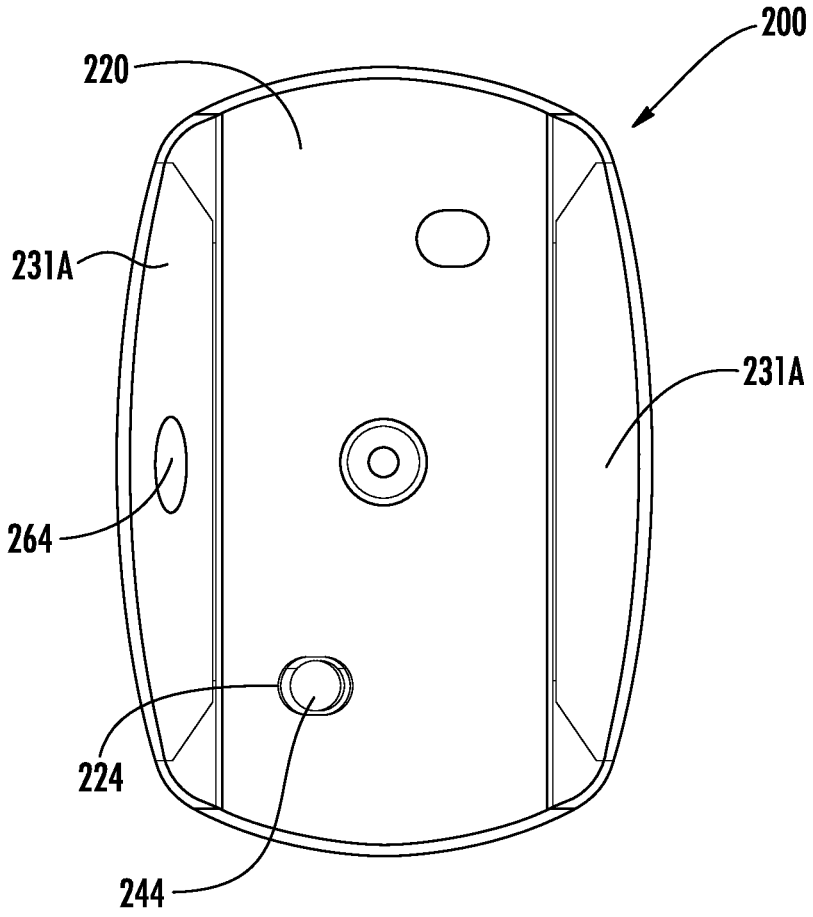
FIG. 27 is a plan view showing the underside of the security device of FIG. 23.

FIG. 21 and FIG. 22 show another exemplary embodiment of a security device, indicated generally at reference character 100. In this embodiment, a housing 130 comprises an alarming mechanism that includes a first actuation mechanism (e.g., a biased plunger) 144 having a switch that is activated when the plunger engages an object, such as a product or packaging for the product, and is at least partially depressed prior to the housing engaging or being secured to a carrier 120. The alarming mechanism may include a second actuation mechanism that is actuated as the housing 130 is moved while in contact with the object. For example, the second actuation mechanism may include a rotatable member, such as a rotatable wheel, 164 that is configured to rotate as the housing 130 is translated along a surface of the object with the plunger 144 at least partially depressed. The rotatable wheel 164 may be located in any desired position on the housing 130 such that the wheel is configured to be movable in direct contact with the object. For example, the wheel 164 may be located approximately in the center of a bottom portion 132 of the housing 130, or alternatively, adjacent an end of the bottom portion of the housing such that translation of the housing along a surface of the object causes the wheel to rotate prior to the housing 130 or the wheel engaging the carrier 120. In another example, the wheel 164 may be located on or proximate to a lateral edge 131A of the bottom portion 132 of the housing 130 such that the wheel is not located within the carrier 120, and furthermore, does not engage the carrier in any manner.

By way of example and not limitation, the second actuation mechanism may be a wheel, a rotary encoder, an optical encoder, or the like, for determining whether the housing 130 has traveled a particular distance, for example between about 0 inches and about 1.0 inches. Alternatively, the second actuation mechanism may determine whether a rotatable member has rotated through a particular angle or number of revolutions, for example, about 4 revolutions, as the housing 130 is being translated relative to the object. Regardless, the sequence of actuation of the first actuation mechanism and the second actuation mechanism arms the alarming mechanism. In this instance, the alarming mechanism may be armed prior to the housing 130 engaging or being secured to the carrier 120. The plunger 144 may engage the object from a direction generally perpendicular to the object, while the wheel 164, for example, may engage the object from a direction generally parallel to the object. Thus, the sequence of actuation of the plunger 144 and the wheel 164 may reduce the incidence of false alarms where housings 130 have been removed and stored randomly in a storage container for subsequent reuse and consequently contact one another due to, or as a result of, inadvertent or intentional actuation of the plunger. In addition, the housing 130 may engage the carrier 120 at either end and from either direction along the central longitudinal axis L1 of the carrier, thereby facilitating easier installation and removal of the housing.

It will be readily understood and appreciated by those skilled in the art that the first actuation mechanism and the second actuation mechanism could be integrated into a single actuation component. For example, a rotatable plunger switch could be provided that is configured to be displaced (e.g., depressed) inwardly towards the housing 130 when engaged with the object or the carrier 120, and subsequently translated along a surface of the object or the carrier 120. In this instance, the carrier 120 may define a recess or hole, similar in function to plunger hole 124, for receiving the single actuation component and thereby secure the housing 130 to the carrier. Alternatively, a purely mechanical actuation mechanism, such as a plunger without associated plunger switch and alarming electronics could be employed to engage a plunger hole 124 defined in the carrier 120. Furthermore, the carrier 120 may define one or more slots 127 extending from one or both ends configured to receive the second actuation mechanism (e.g., wheel 164) therein (see, e.g., FIGS. 21-22). The slots 127 may extend any desired length along the carrier 120 depending on the relative location of the second actuation mechanism on the housing 130. As a result, the second actuation mechanism may not engage the carrier 120 either during installation with the housing 130 or when secured to the housing. Although the plunger 144 may engage the carrier 120 during installation of the housing 130 onto the carrier, the alarming mechanism has already been armed. The plunger 144 may thereafter be received within one of the plunger holes 124 for securing the housing 130 to the carrier 120. Alternatively, a slot may be defined by the carrier 120 for receiving the plunger 144 so that the plunger does not engage the carrier. Still further, the carrier 120 may define a recess, hole or the like, configured to receive the second actuation mechanism and thereby secure the housing 130 to the carrier.

As discussed hereinabove, the alarming mechanism may comprise first and second actuation mechanisms integrated into a single actuation component according to one embodiment. In other words, the alarming mechanism will only actuate when at least two sequences of actuation are performed. FIGS. 23-27 show yet another exemplary embodiment of a security device, indicated generally at reference character 200. In this embodiment, the security device 200 includes a single actuation component configured as a rotatable wheel 264 having dual functionality. According to the illustrated embodiment, the alarming mechanism will arm only when a switch is closed as a result of vertical displacement of the wheel 264 relative to the housing 230, and the wheel travels a predetermined distance of translation, such as by way of example at least about 20 mm. The wheel 264 may be configured to sense translation mechanically, or with an electrical or optical switch. If desired, the wheel 264 may travel in either direction, but does not differentiate between the two opposite directions of rotation. The alarming mechanism may be configured so that only a predetermined number of data points per distance of travel (e.g., one data point for about every 4-5 mm of travel) allows the logic of the alarming mechanism to differentiate between movement in a storage container and an installation/arming event. In addition, a biased mechanical plunger 244 may be used to secure the housing 230 to the carrier 220 via a plunger hole 224, as previously described and best shown with respect to this embodiment in FIG. 27. As a result, a separate plunger switch may be unnecessary. However, a plunger 244 may be operably engaged with a plunger switch in alternative embodiments. Similar to the embodiments discussed above, the housing 230 may include at least one key hole 235 that is configured to receive a key 50 for removing the housing from the carrier 220.

The wheel 264 may be located along one of the lateral edges 231A of the housing. Thus, the wheel 264 may be disposed outside of the carrier slot 231 so that the wheel does not engage with the carrier 220. The wheel 264 could also be located near the center of the housing 230, medially between the opposing ends of the housing. Likewise, numerous other locations of the wheel 264 are possible without departing from the general concept of the invention. If desired, the wheel 264 may have a peripheral surface configured for facilitating engagement with the object and thereby increasing friction therebetween, such as a rubber surface. In addition, the wheel 264 may be engaged with a floating axle 264A for facilitating rotation and vertical displacement of the wheel. In order to facilitate vertical displacement of the wheel 264, the wheel may be biased (e.g., spring loaded) outwardly from the housing 230 to maintain traction on the object. In this instance, the wheel 264 would be configured to deflect vertically upward towards the housing 230 when engaged with the object. The vertical distance of travel allowed by the spring may allow the wheel to be fully deflected within the housing such that the housing lies adjacent to a relatively planar surface of the object. In still another embodiment, an optical sensor, for example an LED or optical transducer, could be utilized to sense the vertical displacement and/or translation of the wheel 264.

Figure 28:
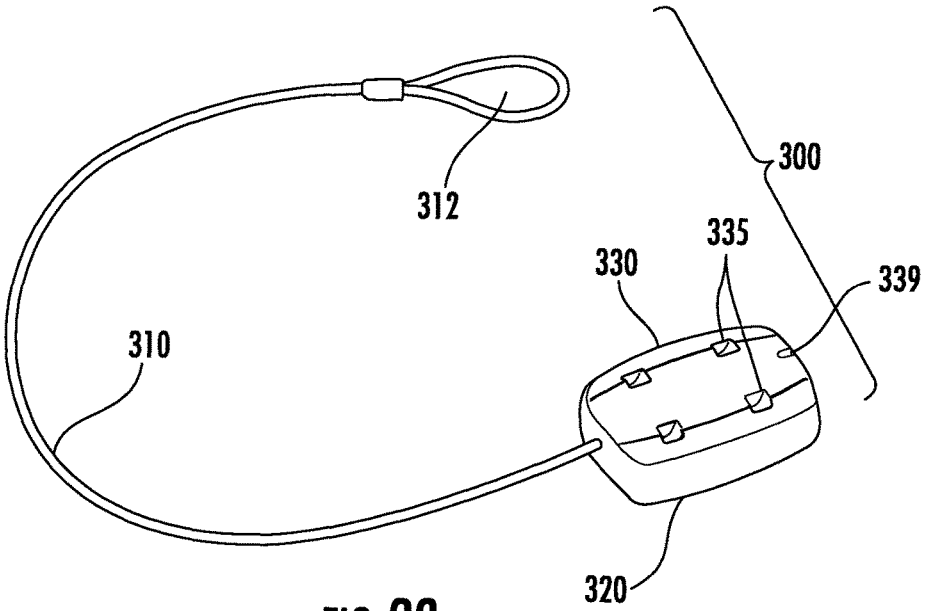
FIG. 28 is a perspective view of another embodiment of a security device according to the invention including a cable.
Figure 29:
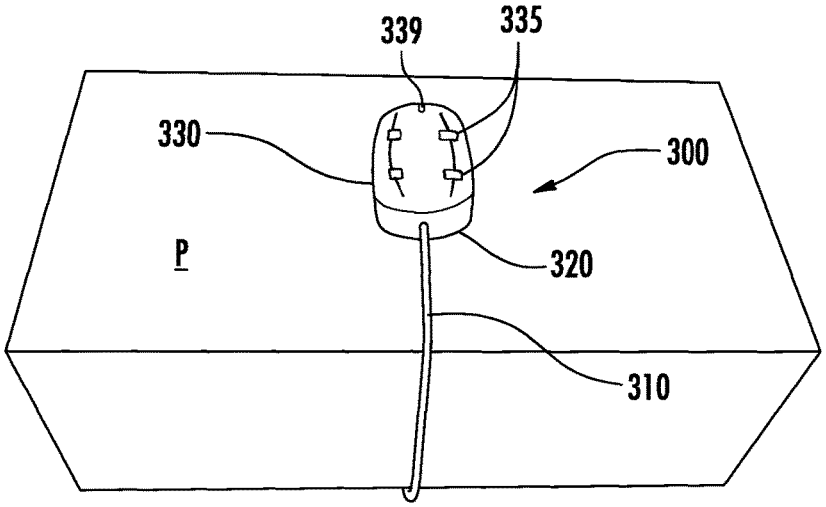
FIG. 29 is a perspective view showing the security device of FIG. 28 affixed to an object and the cable wrapped about the object.

FIG. 28 and FIG. 29 show yet another exemplary embodiment of a security device, indicated generally at reference character 300. In this embodiment, the security device 300 may further include a cable 310 coupled to the first component (e.g., the carrier) 320, or alternatively, to the second component (e.g., the housing) 330 that is configured to secure an object, such as a product or packaging for the product P, from theft or unauthorized removal from a predetermined area. For example, FIG. 28 shows an embodiment of the invention wherein the cable 310 is attached to the housing 330 at one end, and has a loop 312 formed at the opposite free end. The loop 312 may be used to tether the security device 300, and consequently, the product or product packaging P directly to a fixed object, support, surface or the like.

Alternatively, as shown in FIG. 29, the cable 310 may be at least partially wrapped about the product packaging P, for example to secure any openings, lids, flaps, or the like. Therefore, unlike conventional "cable wraps", the security device 300 is less complex, easier to install, and adaptable to secure a variety of objects of different shapes and sizes. Namely, cable wraps typically require more complicated ratcheting mechanisms, multiple wires, and a pair of security devices attached to the multiple wires. As discussed herein below, embodiments of the security device 300 provide a simpler technique to secure an object from theft or unauthorized removal that is readily adaptable to a variety of retail store configurations.

As used herein, the term "cable" is not intended to be limiting and may be any suitable cable, cord, wire, strand, lanyard, or the like. If desired, the cable 310 may be a purely mechanical cable. In various embodiments, the cable 310 may include sensing capability for sensing whether the cable has been cut, severed or detached from the security device. In particular embodiments, the security device 300 comprises a sensing capability that is operable for determining whether one or more conductors communicating with the alarming mechanism have been compromised. Thus, the cable 310 may include one or more conductors that are in electrical communication with the security device 300. The one or more conductors may define a sense loop whereby power and/or security signals are transmitted through the cable 310. When the sense loop is interrupted, the security device 300 is configured to detect such an interruption and generate an alarming signal.

The cable 310 may be any desired length, diameter, and/or material to accommodate a particular object. For example, the cable 310 may include different lengths for accommodating different sized objects. The cable 310 may be any desired material, such as a cut-resistant or metal material, or single or multi-braided material. The cable 310 is typically formed of a relatively flexible material that is configured to conform to objects having various shapes and sizes, and to allow the security device 300 to be oriented in a variety of positions with respect to the cable. Moreover, the cable 310 may be elastic or rigid, and may be adjustable or non-adjustable in length. If the length of the cable 310 is not adjustable, the cable may be readily tensioned to tether an object or to wrap tightly about an object. Although a single cable 310 is shown coupled to the security device 300 in the illustrated exemplary embodiments, it is understood that a plurality of cables 310 may be employed if desired. For instance, the security device 300 may include a pair of cables, with each cable having an end attached to the security device and an opposite free end. Moreover, each cable 310 may be configured to extend from the security device 300 in any desired direction, such as in a direction aligned with the direction of the sliding movement of the housing 330 relative to the carrier 310.

In addition, the cable 310 may be attached to a security device 300 at one end, while the opposite end of the cable remains free, such as for attachment to a fixed object, support, or surface. The free end of the cable could include any suitable feature, such as a loop, fastener, or the like 312 for effectuating such an attachment. The loop 312 could be sized and configured such that the security device 300 (e.g., housing 330 and carrier 320) is capable of being inserted through the loop. Thus, the cable 310 could be looped about or through an object to be protected from theft, such as an item of merchandise having a strap, an opening, or the like, and the security device 300 secured to a fixed object, support, or surface. It is also possible to gang a plurality of security devices 300 together by looping one security device through a loop 312 of another security device. As such, the security device 300 is readily adaptable to a variety of merchandise items and retail environments. As mentioned, one end of the cable 310 is coupled to the security device 300, which may be the housing 330, using any suitable technique. For example, the cable 310 may be attached by inserting an end of the cable through an opening defined in the housing 330 and securing the cable therein, such as with an adhesive or fasteners. The cable 310 is secured to the security device 300 such that the cable may be not easily detached without damaging the security device, or without cutting the cable.

As noted above, the cable 310 may also be configured to at least partially wrap about an object. Thus, a single cable 310 may be employed that wraps circumferentially about the object. In one embodiment, the object is packaging P having a retail item of merchandise disposed therein. In this way, the cable 310 may secure two opposed ends of the packaging P, which may correspond to openings, lids, flaps, or the like for accessing the item of merchandise. The end of the cable 310 opposite the security device 300 may be secured to an object using any suitable technique, such as an adhesive, fastener, or the like. In one embodiment, the opposite end of the cable may be secured to a carrier 320 that is fixed to the object. Thus, the opposite end may not include a housing 330 corresponding to the carrier 320.

In another embodiment, a plurality of security devices 300 are used, and each end of the cable 310 is coupled to a respective one of the security devices. For example, the cable 310 may be attached to a housing 330 of each security device 300. In one use, each security device 300 may be secured to an object, and the cable 310 may be tensioned about the object to secure the object from theft or unauthorized removal. For instance, a first security device 300 may be attached to one surface of the object and the cable 310 may then be wrapped circumferentially about the object. The second security device 300 is then attached to the same surface of the object. Where the length of the cable 310 is longer than the circumference of the object, the cable may be wrapped further about the object such that the security devices 300 are attached to different surfaces of the object. In some cases, the cable 310 may be wrapped a plurality of times about the object such that the security devices 300 are capable of being fixed to the same surface of the object. As such, the plurality of security devices 300 may be adaptable to various object sizes. When securing the security devices 300 to the object, the cable 310 may be manually tightened by tensioning the cable tight prior to securing the second security device 300 to the object.

As previously discussed with respect to the exemplary embodiments of the security device 10, 100, 200, the housing 330 is configured to slidably engage the carrier 320. In particular, the housing 330 may slidably engage the carrier 320 at either end and from either direction along a central longitudinal axis L1 of the carrier. As previously shown and described, the housing 330 may be configured to be slid along a generally planar surface defined by the carrier 320. In some embodiments, the housing 330 may be configured to slidably engage the carrier 320 in only one direction. Thus, wherein at least a pair of security devices 300 is utilized, one of the security devices may be unable to be removed in a direction aligned with the direction that the tension is applied to the cable 310. Thus, attempting to remove the housing 330 of the security device 300 from the carrier 320 would act to further tighten the cable 310.

The foregoing has described exemplary embodiments of a security device for protecting an object from theft or unauthorized removal from a predetermined area. Those of ordinary skill in the art will readily understand and appreciate that numerous variations and modifications of the invention may be made without departing from its intended spirit and scope. Accordingly, all such variations and modifications are intended to be encompassed by the appended claims.

That which is claimed is:

1. A security device comprising:

a housing configured to be attached to an object; and an alarming mechanism at least partially contained by the housing, wherein the alarming mechanism comprises at least one actuation mechanism, and wherein the at least one actuation mechanism is configured to sense both vertical displacement and translation of the housing relative to the object.

2. The security device of claim 1, wherein the alarming mechanism comprises a plurality of actuation mechanisms.

3. The security device of claim 2, wherein one of the actuation mechanisms comprises a plunger switch and the other actuation mechanism comprises a rotatable member.

4. The security device of claim 2, wherein the plurality of actuation mechanisms are integrated into a single actuation component.

5. The security device of claim 1, wherein the at least one actuation mechanism comprises a rotatable plunger switch.

6. The security device of claim 1, wherein the at least one actuation mechanism comprises a plunger.

7. The security device of claim 1, further comprising a carrier configured to be fixed to the object, and wherein the housing is configured to be removably secured to the carrier, and wherein the alarming mechanism is configured to be armed prior to the housing being secured to the carrier.

8. The security device of claim 1, further comprising a cable attached to the housing and configured to extend at least partially about the object.

9. The security device of claim 8, wherein the cable comprises at least one conductor in electrical communication with the alarming mechanism, and wherein the alarming mechanism is configured to detect an interruption in a signal transmitted through the at least one conductor.

10. The security device of claim 8, wherein the cable is a mechanical cable.

11. The security device of claim 8, wherein a length of the cable is adjustable.

12. The security device of claim 1, further comprising a key operable for disarming the alarming mechanism.

13. The security device of claim 1, further comprising an alarm configured to generate an audio and/or a visual alarm signal in response to removal of the housing from the object.

14. A method for securing an object comprising:

attaching a housing to an object, the housing comprising an alarming mechanism, wherein the alarming mechanism comprises at least one actuation mechanism, and wherein the at least one actuation mechanism is configured to sense both vertical displacement and translation of the housing relative to the object.

15. The method of claim 14, further comprising extending a cable attached to the housing at least partially about the object.

16. The method of claim 14, wherein extending comprising wrapping the cable circumferentially about the object.

17. The method of claim 15, further comprising disarming the alarming mechanism with a key.

18. A security device comprising:

a housing configured to be attached to an object; and an alarming mechanism at least partially contained by the housing, wherein the alarming mechanism comprises a rotatable plunger switch configured to sense both vertical displacement and translation of the housing relative to the object.

19. The security device of claim 18, further comprising a cable attached to the housing and configured to extend at least partially about the object.

20. The security device of claim 18, wherein a length of the cable is adjustable.

* * * * *